United States Patent [19]

Kelley

[11] 4,249,438

[45] Feb. 10, 1981

[54] METHOD AND APPARATUS FOR CUTTING SHEET MATERIAL

[76] Inventor: Albert W. Kelley, R.R. 1, Box 28, Creamridge, N.J. 08514

[21] Appl. No.: 46,433

[22] Filed: Jun. 7, 1979

[51] Int. Cl.[3] ..... B26D 1/02

[52] U.S. Cl. ..... 83/53; 83/167; 83/177; 83/417; 83/422; 83/431

[58] Field of Search ..... 83/177, 53, 431, 152, 83/452, 276, 374, 422, 167, 417

[56] References Cited

U.S. PATENT DOCUMENTS

| | | | |
|---|---|---|---|
| 2,416,173 | 2/1947 | Halstead | 83/152 |
| 2,425,039 | 8/1947 | Luehrs | 83/152 X |
| 2,467,172 | 4/1949 | Wheeler | 83/374 X |
| 3,170,353 | 2/1965 | Wheeler et al. | 83/276 |
| 3,171,311 | 3/1965 | Carlson | 83/152 X |
| 3,269,242 | 8/1966 | Hooper et al. | 83/276 X |

*Primary Examiner*—Frank T. Yost

*Attorney, Agent, or Firm*—Robert K. Youtie

[57] ABSTRACT

A sheet cutting method and apparatus wherein a fluid pervious die plate or wall having projecting cutting edges is located facing a sheet to be worked, and a vacuum is transmitted through the wall to draw the sheet against the cutting edges for severance of the sheet.

10 Claims, 4 Drawing Figures

METHOD AND APPARATUS FOR CUTTING SHEET MATERIAL

BACKGROUND OF THE INVENTION

While the method and apparatus of the present invention are primarily intended for use in the cutting and creasing of plastic sheeting, and will be illustrating and described hereinafter with particular reference thereto, it is appreciated that sheeting of other material having similar characteristics may also be worked. While the use of air pressure or suction in the working of sheet material is not broadly new, applicant's specific structure and method are simpler, faster and more economical then those found in the prior art. Representative of the prior art are the below listed U.S. Pat. Nos: 1,549,961; 3,226,458; 2,589,022; 3,321,647; 2,691,797; 3,238,031;

The above patents are not of sufficient pertinence to require discussion.

SUMMARY OF THE INVENTION

Accordingly, it is an important object of the present invention to provide a method and apparatus for working sheet material, particularly in the cutting and creasing of plastic sheeting, which is relatively simple and expeditious, requiring only relatively inexpensive equipment and dies, being highly reliable in operation and effecting substantial savings in costs.

It is a further object of the present invention to provide improvements in apparatus and method for working sheet material. While the sheet working is primarily concerned with blanking, including the formation along desired lines of cuts and creases, such working is also intended to include perforating, serrating and similar working conventionally performed on plastic sheeting, and the like.

Other objects of the present invention will become apparent upon reading the following specification and referring to the accompanying drawings, which form a material part of this disclosure.

The invention accordingly consists in the features of construction, combinations and arrangements of parts and method steps, which will be exemplified in the following description, and of which the scope will be indicated by the appended claims.

DESCRIPTION OF THE PREFERRED EMBODIMENT

Figures 1, 2, 3, 4:
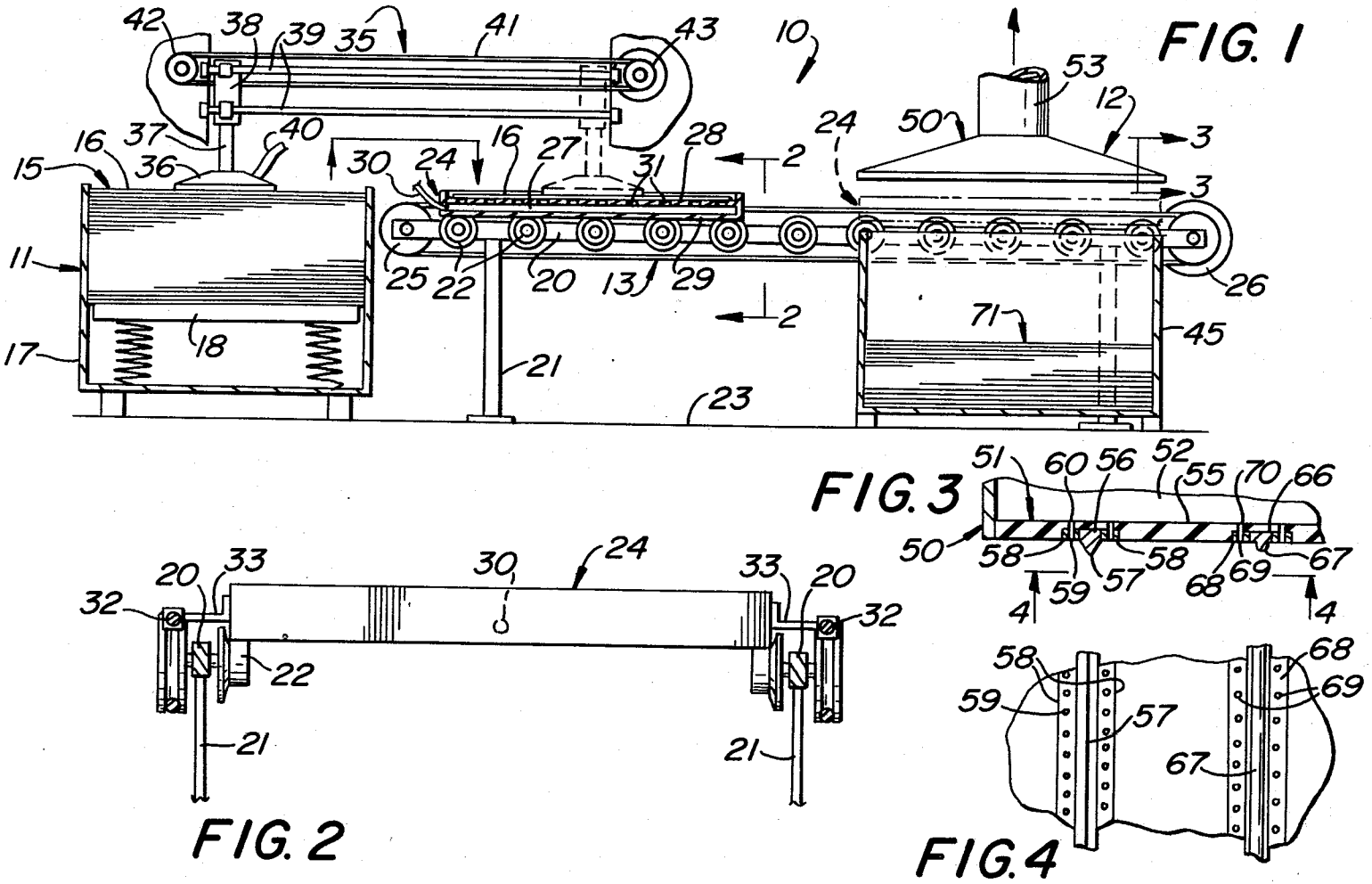
FIG. 1 is a side elevational view, partly in section, showing sheet working apparatus of the present invention in operation practicing the instant method.
FIG. 2 is a sectional elevational view taken generally along the line 2—2 of FIG. 1.
FIG. 3 is a partial sectional elevational view taken generally along the line 3—3 of FIG. 1.
FIG. 4 is a partial view taken generally along the line 4—4 of FIG. 3.

Referring now more particularly to the drawings, and specifically to FIG. 1 thereof, apparatus of the present invention is there generally designated 10, including suitable supply means 11, which may provide a source of sheets to be worked. A sheet working station is generally designated 12 and located adjacent to the source of supply 11, while a conveyor 13 is provided to convey the work sheets from the supply 11 to the work station 12.

While other suitable supply means may be employed, it has been found advantageous to provide a stack 15 of cut sheets 16, which may be carried on suitable skid means 17, as by a vertically upwardly resiliently biased support member or table 18. In this manner, the sheet stack 15 is urged upwardly, and suitable limit means may be provided if desired.

The conveyor 13 may include a pair of laterally spaced rails or tracks 20, suitably supported by upstanding legs 21 on a ground or floor surface 23. The rails 20 extend in generally horizontal, parallel spaced relation with each other, and are each provided on their inner sides with a row of rotary supports or rollers 22. In addition, at opposite ends of the rails 20, upstream and downstream thereof, there may be provided respective shives or pulleys 25 and 26, respectively.

A generally horizontally disposed tray or carrier is designated 24, and may be of rectangular outline design extending laterally between the rails 20 and rollably supported on the spaced rows of rolls 22. The tray or carrier 24 may be internally hollow, including an interior, fluid pressure chamber 27 and having generally horizontal, upper and lower, parallel spaced walls 28 and 29. The upper wall 28 may be fluid pervious, as by perforations, ports or through passageways 31. Also, a fluid conduit 30 is connected to the carrier 24 in fluid communication with the chamber 27, and connected at its other end to a source of fluid under pressure (not shown) and suitable valving, as desired. The upper surface of top wall 28 may define a generally horizontal support or tray for a work sheet 16, as will appear more fully hereinafter.

Trained about each upstream and downstream aligned pair of pulleys 25 and 26 is a flexible elongate member, rope or chain 32, having an upper run spaced above the rollers 22 and a lower run spaced below the rollers. The carrier 24 is connected, as by lateral arms 33 outstanding toward and secured to adjacent upper run portions of flexible elongate, endless members 32. In this manner, by suitable drive means applied to one of the pulleys 25, 26, the tray or carrier 24 is caused to reciprocate back and forth between opposite upstream and downstream ends of the conveyor 13.

A sheet feeder is generally designated 35, and includes a downwardly facing suction cup or lifter 36 depending by a hanger 37 from a block or head 38. That is, the block 38 is mounted for movement along horizontal, generally parallel rails 39 between the solid line position (see FIG. 1) over the sheet stack 15 and the phantom position over the upstream end of conveyor 13. A fluid conduit 40 is connected to the suction head 36 for selectively applying suction thereto and release suction therefrom. The block 38 is horizontally reciprocable by connection to an endless member or belt 41 trained about horizontally spaced pulleys 42 and 43, which are suitably rotated in opposite directions to effect the desired reciprocation of the suction head.

In practice, suitable valving and control means therefore are employed to apply suction to conduit 40 in the solid line position for drawing the uppermost sheet 16 from stack 15 and transferring the sheet to the upper surface of carrier 24. Suction is then released and the suction head returned to its pickup position for repetition of the above described procedure. The downstream end of container 13, rightward as seen in FIG. 1, is located over a receiver or receptacle 45 at the work station 12. The receptacle 45 serves to collect work product, for removal from the apparatus, as will presently become apparent.

Also located at the work station is a hollow work head or vacuum chamber 50 including a lower, generally horizontally disposed, downwardly facing work wall or die plate 51. The interior hollow 52 of the vacuum chamber 50 is connected by a conduit 53 to a suitable source of vacuum, for purposes appearing presently.

The die plate or wall 51 may include a generally flat, relatively rigid, horizontally disposed member 55, having embedded in its underside one or more elongate cutting dies or rules 56. The cutting dies or rules 56 are each provided, extending longitudinally thereof, with a relatively sharp working or cutting edge 57 projecting downwardly from the under surface of the member 55. Extending longitudinally along, and on each side of die member or rule 56 may be an elongate suction member or pad 58, also embedded in the plate member 55 without appreciable projection therefrom. The suction pads 58 may each be provided with fluid passageways, openings or ports 59 which communicate through aligned wall opening 60 to effect communication through the wall or plate 55. That is, the suction pads 58 are in fluid communication between the underside of wall 55 exteriorly of chamber 52 and the upperside of wall 55 interiorly of the chamber.

Additional work members, tools or rules may be provided, as required for sheet material severing.

Further, additional working tools or rules, as at 66 may be embedded in the under surface of wall 55 and provided with a relatively dull work engaging edge 67 projecting downwardly beyond the wall 55. The downwardly projecting edge 67 may be rounded, if desired. Also, the projecting edges of rules 56 and 66 may be provided with other desired configuration, say impaling members for perforating the work, or other.

Extending longitudinally along one or both sides of the rule 66 may be a perforate suction pad 68, having openings, passageways or ports 69 in respective alignment with wall openings, passageways or ports 70 for fluid communication entirely through the wall or plate 55, in the same manner as suction pads 58.

In practice of the instant invention, with a work sheet 16 resting on the upper surface of the wall 28 of carrier 24, the carrier is moved to the phantom position shown in FIG. 1 at the work station 12 beneath the suction head 50. Suction is then applied to the suction head interior hollow or chamber 52 and the nether sheet drawn forcibly against the wall 55 and working dies or rules 56 and 66. The sharp edged rules 56 are thereby caused to sever or cut through the sheet, while the duller edged dies 66 are caused to weaken or crease the sheet. As required, say by reason of sheet thickness or strength, the sheet being worked may be further forcefully applied to the die plate 51 by the application of fluid under pressure through conduit 30 to the chamber 27 in properly timed relation to enhance the working action of the rules or tools 56 and 66. Also, if desired the material being worked may be heated, as by the application of heat to the working dies 56 and 66, or prior to die engagement with the work, as by heating of the pressure chamber wall 28, or otherwise.

After a sheet is applied to the die plate 51, the carrier 24 is retracted horizontally from the work station to its loading station (leftward in FIG. 1), and the vacuum may be released from chamber 52 for gravitational discharge of the worked sheet to the stack 71 in container 45. If desired, the worked sheet may be forcibly discharged by the application of pressure to the interior of chamber 52.

From the foregoing, it is seen that there are provided a highly improved method and apparatus for die cutting and creasing of sheet material, which is extremely simple and economical to practice, effecting substantial savings in time and money, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. Apparatus for cutting plastic sheet material and the like, said apparatus comprising a chamber for connection to a vacuum source, said chamber including a wall adapted to face toward a sheet to be worked, elongate rule means carried by said wall and having a longitudinally extending sharp edge projecting from said wall, vacuum transmission means communicating through said wall for drawing a work sheet toward said wall against said rule means for severance thereby, and fluid pressure means facing toward said wall to assist work sheet movement against said rule means.

2. Apparatus according to claim 1, in combination with a carrier movable toward and away from said wall for carrying a sheet to be worked, said carrier being movable toward said wall for carrying a sheet into facing relation with said wall and away from said wall permitting unobstructed discharge of a worked sheet from said wall.

3. Apparatus according to claim 2, said carrier being reciprocable between a work sheet loading position away from said wall and a sheet working position facing said wall.

4. Apparatus for cutting plastic sheet material and the like, said apparatus comprising a chamber for connection to a vacuum source, said chamber includes a wall adapted to face toward a sheet to be worked, elongate rule means carried by said wall and having a longitudinally extending sharp edge projecting from said wall, vacuum transmission means communicating through said wall for drawing a work sheet toward said wall and against said rule means for severance thereby, a carrier movable toward and away from said wall for carrying a sheet to be worked, said carrier being movable toward said wall for carrying a sheet into facing relation with said wall and away from said wall permitting unobstructed discharge of a worked sheet from said wall, said carrier comprising a fluid pressure chamber having one side facing toward said wall, and fluid pressure transmission means communicating through said one side for assisting work sheet movement against said rule means.

5. Apparatus for cutting plastic sheet material and the like, said apparatus comprising a chamber for connecting to a vacuum source, said chamber including a wall adapted to face toward a sheet to be worked, elongate rule means carried by said wall and having a longitudinally extending sharp edge projecting from said wall, vacuum transmission means communicating through said wall for drawing a work sheet toward said wall and against said rule means for severance thereby, and a carrier movable toward and away from said wall for carrying a sheet to be worked, said carrier being movable toward said wall for carrying a sheet into facing relation with said wall and away from said wall permitting unobstructed discharge of a worked sheet from said wall, said carrier being reciprocable between a work sheet loading position away from said wall and a sheet working position facing said wall, said wall facing generally downwardly for gravitational discharge of a worked sheet when said carrier moves to its loading position.

6. Apparatus according to claim 5, said carrier facing generally upwardly and being located beneath said wall in said sheet working position.

7. Apparatus according to claim 6, in combination with sheet supply means and sheet delivery means for delivering successive sheets from said supply means to said carrier when the latter is in its loading position.

8. The method comprising: providing a die plate having projecting cutting edges and fluid ports along said cutting edges, positioning a work sheet in facing relation with said die plate adjacent to said cutting edges and fluid ports, applying vacuum to said fluid ports remote from said sheet to draw said sheet toward said die plate and against said cutting edges for severing said sheet, and applying fluid pressure to said sheet remote from said plate to assist sheet movement against cutting edges.

9. In the method of die cutting plastic sheet material and the like, the steps which comprise: providing a die plate having projecting cutting edges and fluid ports along said cutting edges, positioning a work sheet in facing relation with said die plate adjacent to said cutting edges and fluid ports, applying vacuum to said fluid ports remote from said sheet to draw said sheet toward said die plate and against said cutting edges for severing said sheet, arranging said die plate facing downwardly, and removing said vacuum to release said worked sheet for gravitational discharge.

10. The method according to claim 9, further characterized in applying fluid pressure to said sheet remote from said plate to assist sheet movement against said cutting edges.

* * * * *